US005649496A

United States Patent [19]

Morita et al.

[11] Patent Number: 5,649,496

[45] Date of Patent: Jul. 22, 1997

[54] HEADGEAR-HOLDER SUPPORTING APPARATUS

[75] Inventors: Tetsuo Morita, Nagoya; Satoshi Kato, Kariya, both of Japan

[73] Assignee: Brother Kogyo Kabushiki Kaisha, Nagoya, Japan

[21] Appl. No.: 605,794

[22] Filed: Feb. 22, 1996

[30] Foreign Application Priority Data

Feb. 27, 1995 [JP] Japan ..... 7-064772
Aug. 28, 1995 [JP] Japan ..... 7-218454

[51] Int. Cl.[6] ..... D05C 9/04

[52] U.S. Cl. ..... 112/103

[58] Field of Search ..... 112/260, 475.11, 112/100, 103 J, 470.13, 470.18, 102.5, 63, 470.14; 38/102.2, 102.91

[56] References Cited

U.S. PATENT DOCUMENTS

| | | | |
|---|---|---|---|
| 4,598,488 | 7/1986 | Inteso | 112/103 X |
| 4,774,778 | 10/1988 | Williams | 38/102.2 |
| 5,167,194 | 12/1992 | Nakagaki | 112/103 |
| 5,261,338 | 11/1993 | Takima et al. | 112/103 |
| 5,277,140 | 1/1994 | Nakagakii | 112/102.5 |

*Primary Examiner*—Ismael Izaguirre
*Attorney, Agent, or Firm*—Oliff & Berridge

[57] ABSTRACT

An apparatus for supporting a headgear holder which holds a headgear, the headgear holder being detachably attached to the apparatus, the apparatus including a main structure which is adapted to be fixed to a base member, a rotatable structure which supports the headgear holder attached thereto, and a connecting device which connects the rotatable structure supporting the headgear holder, to the main structure, such that the rotatable structure is rotatable about an axis line thereof, so that the headgear holder is rotatable around the main structure. An apparatus for supporting a headgear holder which holds a headgear, the headgear holder being detachably attached to the apparatus, the apparatus including a main structure which is adapted to be fixed to a base member, the main structure including a main frame member and a curved frame member, a supporting structure which supports the headgear holder attached thereto and which is connected to the main structure, the curved frame member of the main structure extending into an internal space of a headgear held by the headgear holder supported by the supporting structure, and a position changing device which changes a position of the curved frame member relative to the main frame member in a predetermined direction.

32 Claims, 7 Drawing Sheets

HEADGEAR-HOLDER SUPPORTING APPARATUS

BACKGROUND OF THE INVENTION

1. Field of the Invention

The present invention relates to a headgear-holder supporting apparatus to which a headgear holder detachably attached.

2. Related Art Statement

Conventionally, in the case where an embroidery sewing machine is used to form an embroidery in a headgear having a visor, such as a baseball cap, the headgear is held on a headgear holder and then the headgear holder with the headgear is attached to the embroidery sewing machine. While the headgear holder is moved in a horizontal direction and/or rotated about an axis line parallel to the horizontal direction, the sewing machine forms an embroidery in an embroidery area on the headgear. Meanwhile, when a headgear is set on a headgear holder, a headgear-holder supporting device may be used so that an embroidery area of the headgear held on the headgear holder may have an appropriate curved shape.

There is known a headgear-holder supporting device which includes a main structure which is adapted to be fixed to a base member, such as a table, and which includes a curved portion, and a headgear-holder supporting structure which is integrally connected to the main structure. A headgear holder is detachably attached to the headgear-holder supporting structure.

The headgear holder that is attached to the headgear-holder supporting device is essentially provided by a generally cylindrical main frame member and a pressing frame member which is externally fastened to the main frame member such that the headgear is sandwiched therebetween and that the fastened pressing frame member can be unfastened from the main frame member. One of opposite ends of the pressing frame member is hinged to the main frame member, and the other end thereof is connected via a fastening member to the main frame member. There is also known a headgear holder wherein both of opposite ends of a pressing frame member are connected via respective fastening members to a main frame member.

When a headgear is set on the headgear holder, first, the headgear is put on the main frame member and then the pressing frame member is externally fastened over the headgear. The position and shape of the headgear are minutely adjusted and the pressing frame member is fastened via the fastening member to the main frame member. Thus, the headgear is set or held on the headgear holder.

Recently, in many cases, an embroidery is formed in not only a frontal portion but also one or two temporal portions of a headgear. For those cases, there has been used a headgear holder which holds a headgear such that a large embroidery area including a frontal portion and two temporal portions maintain its appropriate curved shape. In the headgear holder, a pressing frame member is connected at one end or each end thereof to a lateral portion or portions or an even lower portion or portions of a main frame member via a fastening member or members.

However, in the case where a headgear-holder supporting device supports a headgear holder which holds a headgear whose temporal portion or portions are to be embroidered, an operator cannot easily see the temporal portions of the headgear or the fastening member or members of the pressing frame member. Therefore, it needs a long working time to complete the setting of a headgear on the headgear holder by putting the headgear on the main frame member, fastening the pressing frame member over the headgear to the main frame member, and adjusting the positions and shapes of the embroidery areas in the temporal portions of the headgear. Thus, the working efficiency is very low.

In the above-identified headgear-holder supporting device, the curved portion of the main structure extends into an internal space of a headgear held by the headgear holder attached to the headgear-holder supporting structure. Thus, the headgear is held on the headgear holder such that the embroidery areas (i.e., frontal and temporal portions) of the headgear have appropriate shapes for embroidering.

However, in the above prior headgear-holder supporting device, the main structure has an unchangeable dimension in a direction in which the curved portion thereof extends into the internal space of the headgear. Therefore, the prior device cannot be used for setting each of headgears in various sizes on the headgear holder while appropriately stretching an embroidery area of each headgear on the headgear holder.

SUMMARY OF THE INVENTION

It is a first object of the present invention to provide a headgear-holder supporting apparatus which includes a rotatable structure for supporting a headgear holder and accordingly ensures that a headgear is easily and appropriately set on the headgear holder.

It is a second object of the present invention to provide a headgear-holder supporting apparatus which ensures that each of headgears in various sizes is held on the headgear holder while an embroidery area of the headgear is appropriately stretched on the headgear holder.

The above first object has been achieved according to a first aspect of the present invention, which provides an apparatus for supporting a headgear holder which holds a headgear, the headgear holder being detachably attached to the apparatus, the apparatus comprising a main structure which is adapted to be fixed to a base member, a rotatable structure which supports the headgear holder attached thereto, and a connecting device which connects the rotatable structure supporting the headgear holder, to the main structure, such that the rotatable structure is rotatable about an axis line thereof, so that the headgear holder is rotatable around the main structure.

In the headgear-holder supporting apparatus in accordance with the first aspect of the invention, the rotatable structure supporting the headgear holder, is connected to the main structure, such that the rotatable structure is rotatable about an axis line thereof, and accordingly the headgear holder supported by the rotatable structure is rotatable around the main structure. Therefore, a temporal portion of the headgear held by the headgear holder can be moved on the headgear holder, from a lateral side of the present apparatus which is difficult for an operator to see, to a top portion of the same which is easy to see. Thus, the operator can easily and appropriately adjust or correct, on the headgear holder, the position and/or shape of a sewing or embroidering area of the temporal portion of the headgear. The amount of operator's work is reduced and the working efficiency is improved.

According to a preferred feature of the first aspect of the invention, the main structure comprises a fixed member which is adapted to be fixed to the base member, and a main frame member which is secured to the fixed member and which extends into an inside space of the headgear holder attached to the rotatable structure. The main frame member may comprise a curved portion. The curved portion may have a part-cylindrical shape.

According to another feature of the first aspect of the invention, the connecting device comprises an arcuate guide provided on one of the main structure and the rotatable structure, and at least one guided member which is provided on the other of the main structure and the rotatable structure and which is guided by the arcuate guide. The arcuate guide may comprise an arcuate groove formed in the one of the main structure and the rotatable structure, and the at least one guided member may comprise a plurality of projecting members which project from the other of the main structure and the rotatable structure and which fit in the arcuate groove. The plurality of projecting members may be replaced by a single arcuate projecting member which has the same radius of curvature as that of the arcuate groove and which fits in the arcuate groove. Otherwise, the arcuate guide may comprise an arcuate ridge and the guided member may comprise a plurality of pairs of rollers which pinch the arcuate ridge at respective positions distant from each other.

According to another feature of the first aspect of the invention, the connecting device comprises an arcuate slit formed through a thickness of the rotatable structure, and a plurality of pin members which are secured to the main structure and which extend through the arcuate slit. In this case, the connecting device enjoys a simple construction which contributes to reducing the overall production cost of the present apparatus.

According to another feature of the first aspect of the invention, the headgear-holder supporting apparatus further comprises a free-rotation inhibiting device which inhibits the rotatable structure from being freely rotated relative to the main structure, such that the rotatable structure is forcedly rotatable relative to the main structure. In this case, the headgear holder supported on the rotatable structure can effectively be inhibited from being freely rotated because of considerably small external forces exerted thereto. Thus, the headgear holder can be stopped at an appropriate angular position where the operator can easily set a headgear on the holder or can appropriately adjust a position and/or a shape of the headgear being set on the holder.

According to another feature of the first aspect of the invention, the free-rotation inhibiting device comprises a fastening device which fastens the rotatable structure to the main structure such that the rotatable structure being fastened is unfastenable from the main structure. In the case where the connecting device comprises an arcuate slit formed through a thickness of the rotatable structure, and a plurality of pin members which are secured to the main structure and which extend through the arcuate slit, the fastening device may comprise at least one threaded hole formed in the main structure, and at least one of the pin members which includes a threaded portion engageable with the threaded hole and additionally includes a manually operable knob having a dimension greater than a width of the arcuate slit, the rotatable structure being fastened to the main structure by rotating the knob of the one pin member until the rotatable structure is sandwiched and fixed between the main structure and the knob of the one pin member. In this case, the fastening device enjoys a simple construction which contributes to reducing the overall production cost of the present apparatus. In addition, since the fastening device shares one or more pin members with the connecting device, the overall construction of the present apparatus is simplified.

According to another feature of the first aspect of the invention, the free-rotation inhibiting device comprises a snap-action device which inhibits, by snap action, the rotation of the rotatable structure relative to the main structure. The snap-action device may comprise a plurality of engageable holes formed in one of the rotation structure and the main structure such that the holes are equiangularly spaced from each other, and an engageable projection projecting from a sheet-like spring member fixed to the other of the rotation structure and the main structure such that the projection is engaged with, and disengaged from, each of the holes when the rotatable structure is rotated relative to the main structure. Otherwise, the snap-action device may comprise a single engageable hole formed in a sheet-like spring member fixed to one of the rotation structure and the main structure, and a plurality of equiangularly spaced, engageable projections projecting from the other of the rotation structure and the main structure. In the latter case, the hole is engaged with, and disengaged from, each of the projections when the rotatable structure is rotated relative to the main structure.

According to another feature of the first aspect of the invention, the rotatable structure comprises a holding device which holds the headgear holder attached thereto. The holding device may comprise one of at least one projection which is engageable with at least one hole formed in the headgear holder and at least one hole which is engageable with at least one projection projecting from the headgear holder. In addition, the holding device may comprise one of a combination of at least one roller which is engageable with at least one hole formed in the headgear holder and at least one guide plate which cooperates with the at least one roller to hold the headgear holder, and at least one hole which is engageable with at least one roller and at least one guide plate provided on the headgear holder.

According to another feature of the first aspect of the invention, the holding device comprises at least one projection which projects from the rotatable structure and which is engageable with at least one first hole formed in the headgear holder, and comprises a plurality of rollers which are engageable with a plurality of second holes formed in the headgear holder, and a plurality of guide plates which cooperate with the corresponding ones of the rollers to hold the headgear holder, the plurality of rollers comprising two rollers which are provided on the rotatable structure, on both sides of the projection, the plurality of guide plates comprising two guide plates corresponding to the two rollers, the headgear holder being attached to the rotatable structure by first engaging the projection with the first hole formed in the headgear holder and subsequently rotating, like a lever, the headgear holder about the projection and hole being engaged, so that the two rollers and the two guide plates are engaged with corresponding two second holes of the plurality of second holes of the headgear holder. Thus, the headgear holder can easily be attached to the rotatable structure with a considerably small force.

The above second object has been achieved according to a second aspect of the present invention, which provides an apparatus for supporting a headgear holder which holds a headgear, the headgear holder being detachably attached to the apparatus, the apparatus comprising a main structure which is adapted to be fixed to a base member, the main structure comprising a main frame member and a curved frame member, a supporting structure which supports the headgear holder attached thereto and which is connected to the main structure, the curved frame member of the main structure extending into an internal space of a headgear held by the headgear holder supported by the supporting structure, and a position changing device which changes a position of the curved frame member relative to the main frame member in a predetermined direction.

In the headgear-holder supporting apparatus in accordance with the second aspect of the invention, the position changing device changes a position of the curved frame member relative to the main frame member in a predetermined direction. Thus, the present apparatus can be applied to various sizes of headgears (in particular, various depths), by changing the position of the curved frame member relative to the main frame member. That is, a sewing (or embroidering) area or areas of a headgear in each size can appropriately be stretched on the headgear holder.

According to a preferred feature of the second aspect of the invention, the main structure comprises a fixed member which is adapted to be fixed to the base member, the main frame member being secured to the fixed member and extending in an inside space of the headgear holder attached to the supporting structure.

According to another feature of the second aspect of the invention, the main frame member comprises a curved portion, the curved frame member having the same curved shape as the curved shape of the curved portion. The main frame member may comprise a part-cylindrical portion as the curved portion, and the predetermined direction may be substantially parallel to a center axis line of the part-cylindrical portion.

According to another feature of the second aspect of the invention, the headgear-holder supporting apparatus further comprises a guiding device which guides a movement of the curved frame member relative to the main frame member in the predetermined direction. The guiding device may comprise an engagement recess formed in one of the main and curved frame members, an engagement projection projecting from the other of the main and curved frame members and held in engagement with the engagement recess, and at least one curved guide plate which is fixed to the main frame member and guides the movement of the curved frame member. In the latter case, the guiding device enjoys a simple construction.

According to another feature of the second aspect of the invention, the position changing device comprises a continuously moving device which changes the position of the curved frame member relative to the main frame member in the predetermined direction, by continuously moving and positioning the curved frame member relative to the main frame member. The continuously moving device may comprise a connecting member which includes a first portion thereof connected to one of the main and curved frame members such that the connecting member is rotatable about an axis line thereof, and not immovable in an axial direction thereof, relative to the one of the main and curved frame members and which includes an externally threaded second portion threadedly engaged with, and extending through, an internally threaded hole formed in the other of the main and curved frame members. In the latter case, the continuously moving device enjoys a simple construction. The continuously moving device may further comprise a first projection projecting from the main frame member, and a second projection projecting from the curved frame member, the first portion of the connecting member being connected to one of the first and second projections such that the connecting member is rotatable about the axis line thereof, and not immovable in the axial direction thereof, relative to the one projection and the externally threaded second portion thereof is threadedly engaged with, and extends through, the internally threaded hole formed in the other projection.

According to another feature of the second aspect of the invention, the connecting member may comprise a manually operable knob provided at one of opposite ends thereof, the one end being nearer to the first portion of the connecting member than the externally threaded second portion of the connecting member, the curved frame member being continuously moved relative to the main frame member in the predetermined direction by rotating the knob of the connecting member. The first portion of the connecting member may be connected to the main frame member and the externally threaded second portion of the connecting member is threadedly engaged with the curved frame member.

According to another feature of the second aspect of the invention, the connecting member comprises a manually operable knob provided at one of opposite ends thereof, the one end being more remote from the first portion of the connecting member than from the externally threaded second portion of the connecting member, the curved frame member being continuously moved relative to the main frame member in the predetermined direction by rotating the knob of the connecting member. The first portion of the connecting member may be connected to the main frame member and the externally threaded second portion of the connecting member is threadedly engaged with the curved frame member.

According to another feature of the second aspect of the invention, the position changing device comprises a snap-action device which inhibits, by snap action, the movement of the curved frame member relative to the main frame member. The snap-action device may comprise a plurality of engageable holes formed in one of the main and curved frame members such that the holes are equidistantly spaced from each other in the predetermined direction, and an engageable projection projecting from a sheet-like spring member fixed to the other of the main and curved frame members such that the projection is engaged with, and disengaged from, each of the holes when the curved frame member is moved relative to the main frame member. Otherwise, the snap-action device may comprise a single engageable hole formed in a sheet-like spring member fixed to one of the main and curved frame members, and a plurality of equidistantly spaced, engageable projections projecting from the other of the main and curved frame members. In the latter case, the hole is engaged with, and disengaged from, each of the projections when the curved frame member is moved relative to the main frame member.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
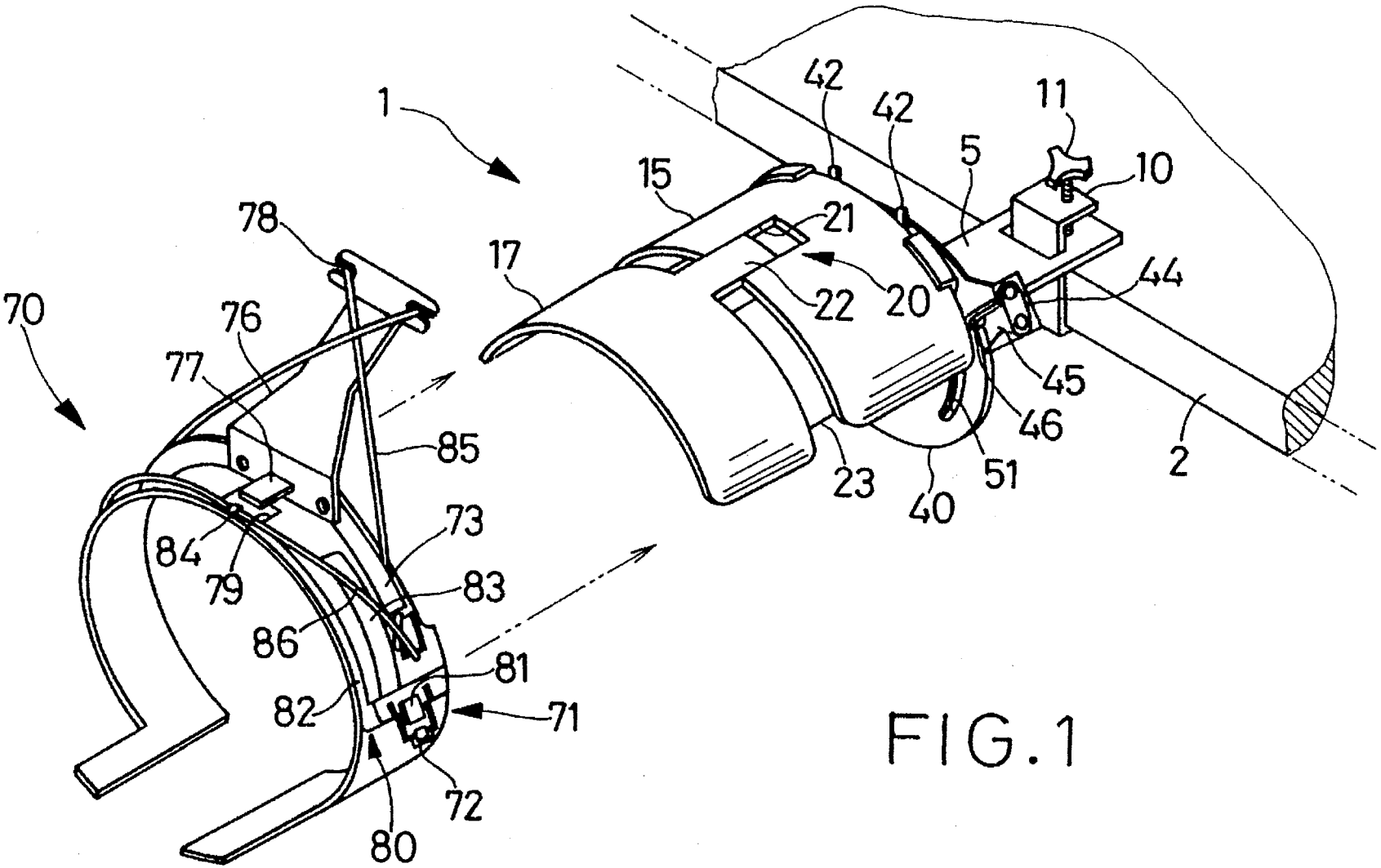
FIG. 1 is a perspective view of a cap-holder supporting apparatus embodying the present invention and a cap holder detachably attached to the supporting apparatus.

Referring to FIGS. 1–6, there is shown a cap-holder supporting apparatus 1 to which the present invention is applied and to which a cap holder 70 for holding a cap such as a baseball cap is detachably attached. However, the principle of the present invention is generally applicable to a headgear-holder supporting apparatus to which a headgear holder for holding a headgear is detachably attached.

As shown in FIGS. 1 to 4, the present cap-holder supporting apparatus 1 includes a fixed frame member 5, a first part-cylindrical frame member 15, a second part-cylindrical frame member 17, a guiding device 20, a position changing device 30, a cap-holder supporting rotatable structure 40, a connecting device 50, and a fastening device 60. The fixed frame member 5 is adapted to be fixed to a table 2 as an external base member. The first part-cylindrical frame member 15 is integrally connected to the fixed frame member 5. The second part-cylindrical frame member 17 is provided in front of the first part-cylindrical frame member 15 in such a manner that the position of the second part-cylindrical frame member 17 relative to the first part-cylindrical frame member 15 is changeable with respect to a front-rear direction of the apparatus 1 which is substantially parallel to a common center axis line of the two part-cylindrical frame members 15, 17 that have a same radius of curvature.

The guiding device 20 guides the movement of the second part-cylindrical frame member 17 such that the second part-cylindrical frame member 17 is movable relative to the first part-cylindrical frame member 15 in the front-rear direction only. The position changing device 30 is manually operable for changing the position of the second part-cylindrical frame member 17 relative to the first part-cylindrical frame member 15 in the front-rear direction. The cap holder 70 is detachably attached to the cap-holder supporting rotatable structure 40. With the cap holder 70 being supported on the rotatable structure 40, the first part-cylindrical frame member 15 extends in an inside space of a generally cylindrical main frame member 71 of the cap holder 70, and the second part-cylindrical frame member 17 extends into an internal space of a cap (not shown) held by the cap holder 70.

The connecting device 50 connects the cap-holder supporting rotatable structure 40 to the fixed frame member 5, such that the rotatable structure 40 is rotatable relative to the fixed frame member 5. The fastening device 60 fastens the cap-holder supporting rotatable structure 40 to the fixed frame member 5, in such a manner that the rotatable structure 40 can be unfastened from the frame member 5.

First, the fixed frame member 5 will be described in detail.

Figure 2:
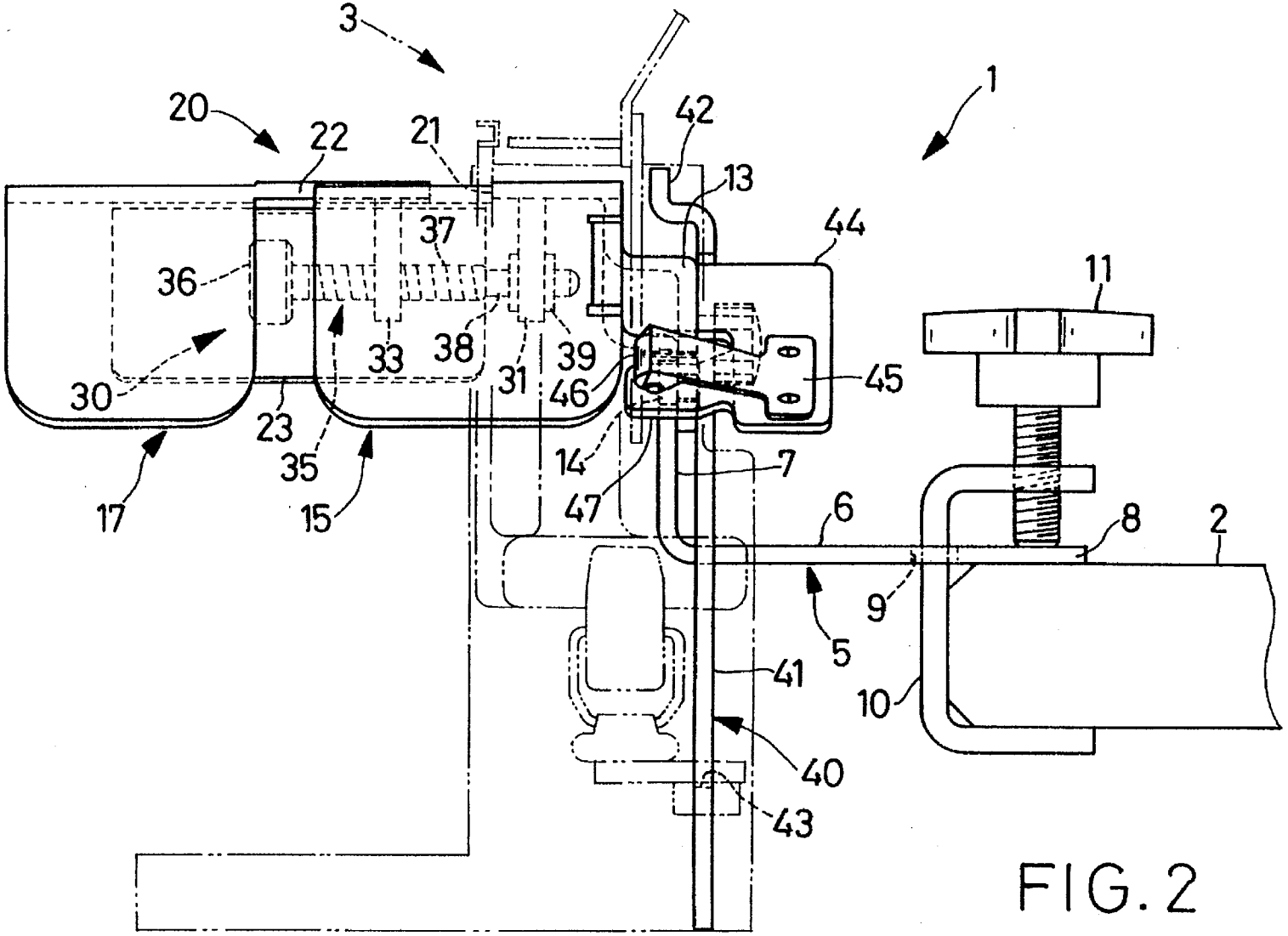
FIG. 2 is a lateral elevation view of the cap-holder supporting apparatus of FIG. 1.
Figure 3:
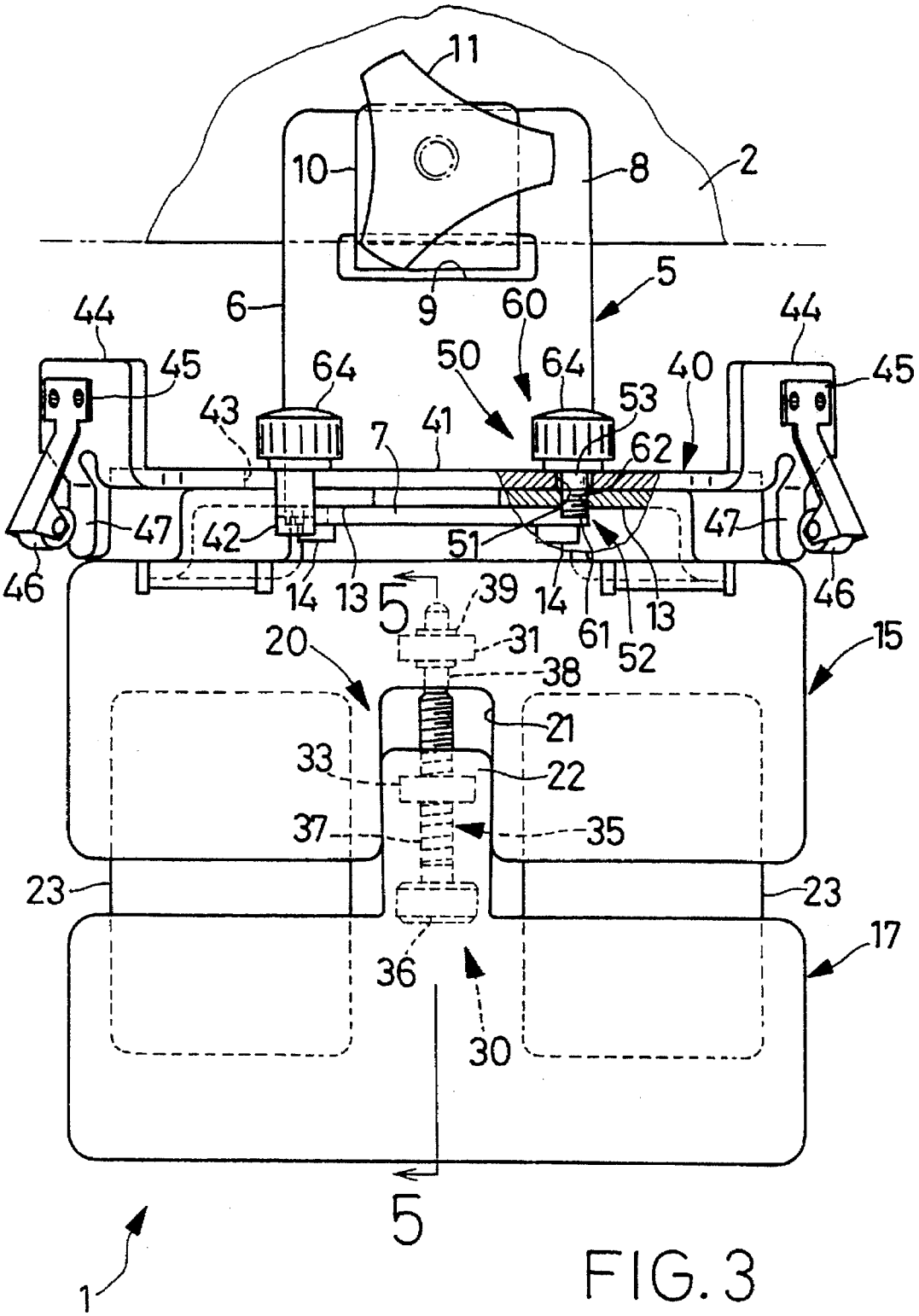
FIG. 3 is a plan view of the cap-holder supporting apparatus of FIG. 1.

As shown in FIGS. 2 and 3, the fixed frame member 5 includes a horizontal portion 6 having a predetermined length in the front-rear direction, and a vertical portion 7 having a length equal to about half the length of the horizontal portion 6. Thus, the fixed frame member 5 is provided by a plate member having an L-shaped cross section as shown in FIG. 2. The horizontal portion 6 includes an end or base portion 8 at which the fixed frame member 5 is fixed to the table 2. The horizontal portion 6 has an elongate hole 9 in front of the base portion 8. A metal member 10 having a U-shaped cross section is inserted through the hole 9, and a fastening bolt 11 is threadedly engaged with a top portion of the metal member 10. The metal member 10 and the fastening bolt 11 cooperate with each other to fasten the fixed frame member 5 to the table 2 such that the fixed frame member 5 can be unfastened or released from the table 2.

Two connecting members 13 are fixed with respective bolts 14 to two upper corners of the vertical portion 7 of the fixed frame member 5. A rear end portion of the first part-cylindrical frame member 15 is fixed to respective upper end portions of the connecting members 13. The first part-cylindrical frame member 15 is integrally connected to the fixed frame member 5 via the connecting members 13.

Next, there will be described the first and second part-cylindrical frame members 15, 17 and the guiding device 20.

Figure 5:
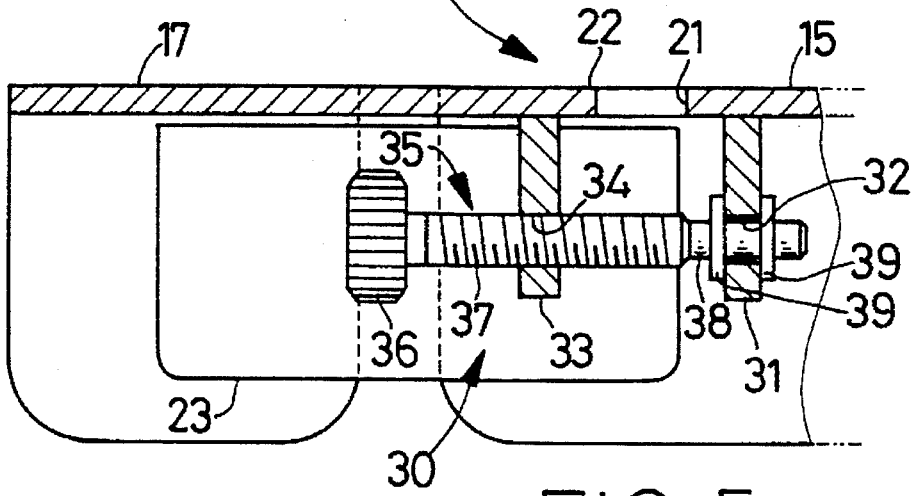
FIG. 5 is a cross-section view taken along line 5—5 in FIG. 3.

As shown in FIGS. 2, 3, and 5, the first part-cylindrical frame member 15 has an engagement recess 21 formed in a top portion of a front end portion thereof. The engagement recess 21 opens in a front end of the first part-cylindrical frame member 15. The second part-cylindrical frame member 17 has an engagement projection 22 projecting rearward from a top portion of a rear end portion thereof. The engagement projection 22 is held in engagement with the engagement recess 21. A pair of part-cylindrical guide plates 23 are fixed, at respective rear portions thereof, to a lower surface of the first part-cylindrical frame member 15. Respective front portions of the two guide plates 23 project frontward from the first part-cylindrical frame member 15, and cooperate with each other to support a lower surface of the second part-cylindrical frame member 17. Thus, the engagement recess and projection 21, 22 and the guide plates 23 cooperate with one another to provide the guiding device 20 for guiding the movement of the second part-cylindrical frame member 17 such that the frame member 17 is movable relative to the first part-cylindrical frame member 15 in the front-rear direction only.

There will be described the position changing device 30 for changing the position of the second part-cylindrical frame member 17 relative to the first part-cylindrical frame member 15 in the front-rear direction.

As shown in FIG. 5, the position changing device 30 includes a first and a second projection 31, 33, and a screw member 35 with a manually operable knob 36. The first projection 31 projects from the lower surface of the first part-cylindrical frame member 15, and the second projection 33 projects from the lower surface of the second part-cylindrical frame member 17. The screw member 35 includes an externally threaded axis portion 37, and a small-diameter axis portion 38 whose diameter is smaller than that of the threaded portion 37. The small-diameter axis portion 38 is inserted through a support hole 32 formed through the thickness of the first projection 31. The small-diameter axis portion 38 is connected, with two ring members 39, such as E rings, provided on both sides of the first projection 31, to the first projection 31 such that the screw member 35 is rotatable about an axis line thereof and is not movable relative to the first projection 31 in the axial direction thereof, i.e., in the front-rear direction. The two ring members 39 may be replaced by two spring pins which are inserted in two holes formed through the axis portion 38, respectively. The threaded axis portion 37 is inserted through, and engaged with, an internally threaded hole 34 formed through the thickness of the second projection 33. The knob 36 is secured to a front end of the threaded axis portion 37. When the knob 36 is manually rotated by an operator or worker, the screw member 35 is rotated about the axis line thereof, so that the second part-cylindrical frame member 17 is moved via the second projection 33 relative to the first part-cylindrical frame member 15 in the front-rear direction, while being guided by the guiding device 20. Thus, the position of the second part-cylindrical frame member 17 is changed relative to the first part-cylindrical frame member 15 in the front-rear direction.

There will be described the cap-holder supporting rotatable structure 40.

Figure 4:
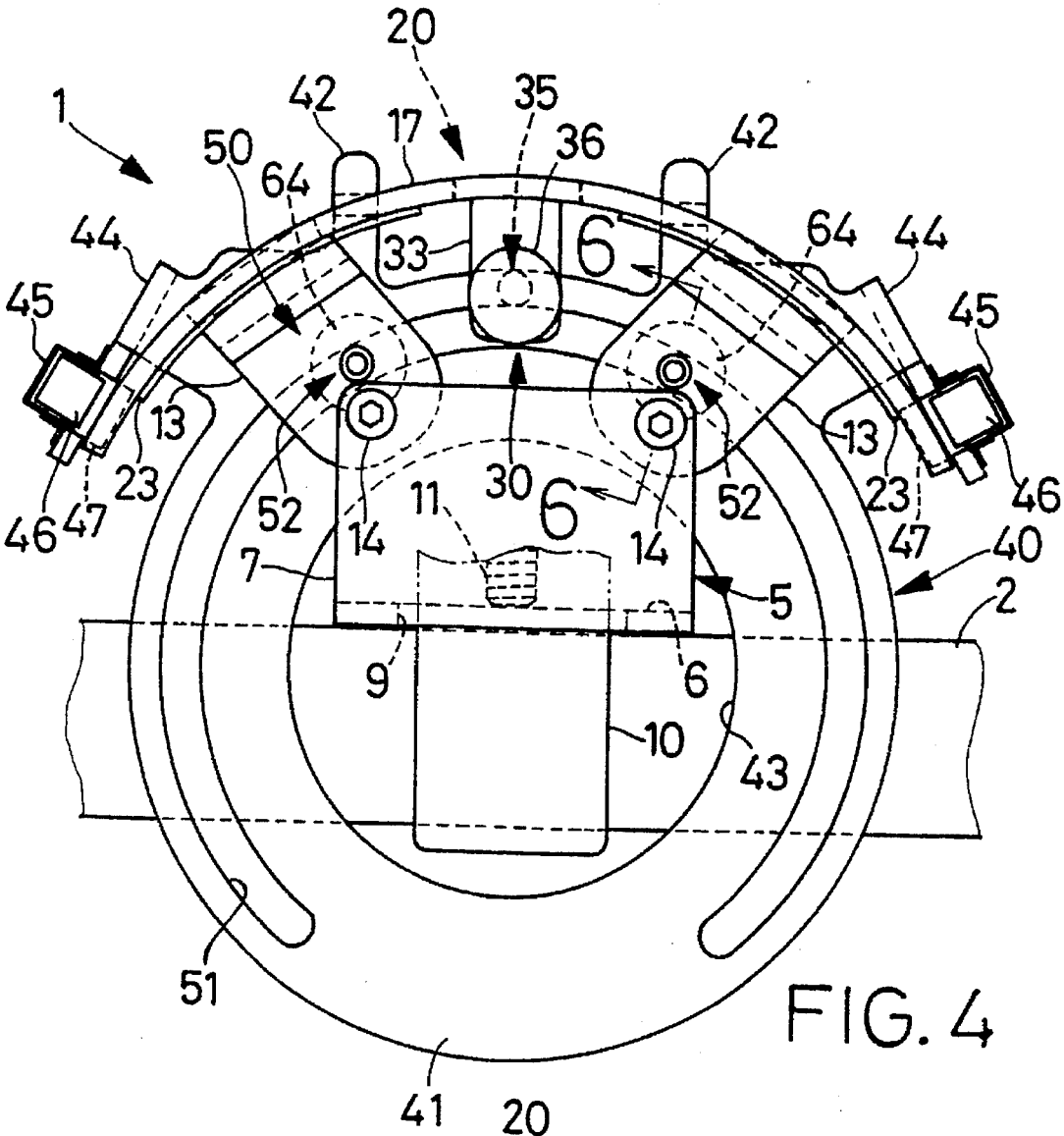
FIG. 4 is a front elevation view of the cap-holder supporting apparatus of FIG. 1.

As shown in FIGS. 2 to 4, the cap-holder supporting rotatable structure 40 includes a disc-like wall member 41, and a pair of crank-like upward projections 42 projecting upward from a top portion of the wall member 41. The wall member 41 has an insertion hole 43 which is concentric with the disc-like wall member 41 and whose diameter is equal to about three fifths of that of the wall member 41. The wall member 41 also has an arcuate slit 51 located radially outwardly of the insertion hole 43. The arcuate slit 51 is concentric with the wall member 41, and extends over about 290 degrees around the insertion hole 43.

The rotatable structure 40 additionally has a pair of roller supporting portions 44 which are located outside the two upward projections 42, respectively, and each of which projects rearward from the top portion of the wall member 41. Each roller supporting portion 44 supports a roller member 46 via a sheet-like spring 45. A front half portion of the sheet-like spring 45 extends frontward over the wall member 41, and a rear end portion of the spring 45 is fixed with vises to the supporting portion 44. The roller member 46 is supported by a front end portion of the spring 45 such that the roller member 46 is rotatable about an axis member. Each roller supporting portion 44 includes a plate-like guide portion 47 which projects frontward from a front end of the supporting portion 44, over the wall member 41, and which is opposed to a corresponding roller member 46. The two roller members 46 and the two guide portions 47 cooperate with one another to pinch and hold a rear end portion of the cylindrical main frame member 71 of the cap holder 70. The two guide portions 47 cooperate with each other to guide the movement of the rear end portion of the main frame member 71 when the operator attaches the cap holder 70 to the rotatable structure 40. The upward projections 42 and the roller supporting portions 44 are integrally formed with the wall member 41.

A front end portion of the horizontal portion 6 of the fixed frame member 5 is inserted through the insertion hole 43 of the wall member 41, and the rotatable structure 40 is connected, by the connecting device 50, to the two connecting members 13 secured to the vertical portion 7 of the fixed frame member 5, such that the rotatable structure 40 is rotatable about a center axis line of the disk-like wall member 41 that is coaxial with the center axis line of the first and second part-cylindrical frame members 15, 17.

Next, there will be described the connecting device 50 and the fastening device 60.

Figure 6:
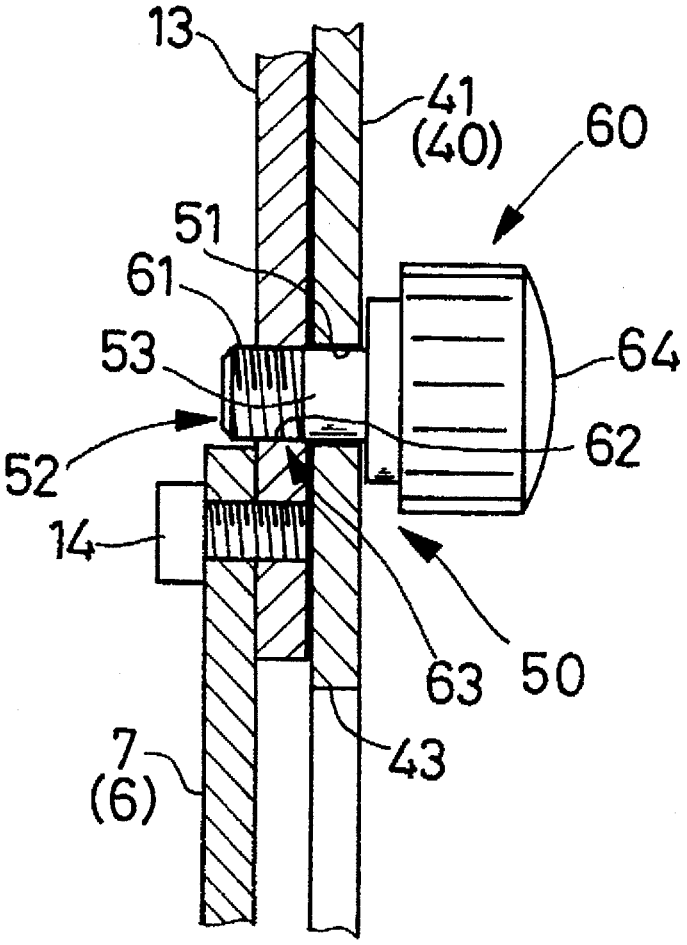
FIG. 6 is a cross-section view taken along line 6—6 in FIG. 4.

As shown in FIGS. 4 and 6, the connecting device 50 includes the arcuate slit 51 formed through the thickness of the wall member 41 of the rotatable structure 40, and a pair of pin members 52 which are threadedly engaged with the two connecting members 13, respectively, and which extend through the arcuate slit 51. More specifically described, each pin member 52 has an axis portion 53 which extends through the arcuate slit 51 of the rotatable structure 40, and an externally threaded end portion 61 which is integrally formed with the axis portion 53 and which is threadedly engaged with an internally threaded hole 62 of a corresponding connecting member 13.

The fastening device 60 includes the two pin members 52, and two threaded portions 63 and a knob 64 which are associated with each of the two pin members 52. Each of the two threaded portions 63 are provided by the threaded portion 61 and the threaded hole 62. When each knob 64 is manually rotated by the operator, a distance between the knob 64 and a corresponding connecting member 13 decreases because of the threaded engagement of the two threaded portions 63 (61, 62), so that the rotatable structure 40 is sandwiched and fixed by being pinched by the knob 64 and the connecting member 13.

Next, there will be described the cap holder 70 which is attached to the present cap-holder supporting apparatus 1 constructed as described above.

As shown in FIG. 1, the cap holder 70 includes the cylindrical main frame member 71 which has a predetermined length in the front-rear direction and which is detachably attached to the rotatable structure 40. The cap holder 70 additionally includes a pressing frame member 80 which is externally and detachably attached to the cylindrical main frame member 71 with a cap being held therebetween. The pressing frame member 80 has two connecting metal members 81 (only one 81 is shown in FIG. 1) provided at opposite ends thereof. Each metal member 81 is connectable to a corresponding one of two hook members 72 (only one 72 is shown) provided on the cylindrical main frame member 71.

The rear end portion of the cylindrical main frame member 71 has four engageable holes (not shown) which are engageable with the two upward projections 42, and the two pairs of roller members 46 and guide portions 47, of the rotatable structure 40, respectively. The cap holder 70 has a partial flange member 73 provided on an intermediate portion thereof as seen in the front-rear direction. The partial flange member 73 has two pairs of recesses formed in opposite end portions thereof, respectively. A viser supporting member 76 for supporting the riser of the cap is fixed to a top portion of the flange member 73, such that the viser supporting member 76 extends obliquely, i.e., upward and rearward. The viser supporting member 76 has two recesses 78 formed in a top end portion thereof. A first elastic cord 85 is engaged with the recesses 78 for biasing the viser of the cap in the rearward direction against the viser supporting portion 76. Each of opposite end portions of the first elastic cord 85 is connected to one recess of a corresponding one pair out of the two pairs of recesses of the partial flange portion 73.

A stopper member 77 is fixed to a bottom portion of the viser supporting member 76, for internally contacting a middle portion of a curved base portion of the viser of the cap. The cylindrical main frame member 71 has a recess 79 formed through the thickness of a top portion thereof. Under the pressing frame member 80, a cloth-based, soft, frontal portion of the cap is so deformed as to enter the recess 79. The pressing frame member 80 includes a pressing frame portion 82 with a small width, and a pair of right and left pressing strips 83 (only the right one 83 is shown). The pressing frame portion 82 extends along the curved base portion of the viser of the cap, and presses the frontal portion of the cap and respective front-side half portions of the right and left temporal portions of the cap, against the cylindrical main frame member 71. The two pressing strips 83 press, against the main frame member 71, a sweat absorbing member of the cap being unfolded and kept outside. A hook member 84 having a U-shaped cross section is fixed to a top, middle portion of the pressing frame portion 82. A middle portion of a second elastic chord 86 is engaged with the hook member 84, and each of opposite end portions of the second elastic chord 86 is connectable to the other recess of a corresponding one pair out of the two pairs of recesses of the partial flange portion 73.

Next, there will be described the manner in which the cap holder 70 is attached to the cap-holder supporting apparatus 1. As described above, the first part-cylindrical frame member 15 is fixed via the two connecting members 13 to the fixed frame member 5 which in turn is fixed to the table 2 with the help of the metal member 10 and the fastening bolt 11.

In the above-indicated state, the operator or worker sets a cap on the cap holder 70, as follows: First, the position of the second part-cylindrical frame member 17 relative to the first part-cylindrical frame member 15 is changed, as needed, to an appropriate position corresponding to a depth of the cap being set. The position changing device 30 is manually operable for moving the second part-cylindrical frame member 17 relative to the first part-cylindrical frame member 15 in the front-rear direction. The second part-cylindrical frame member 17 is permitted, by the guiding device 20, to move relative to the first part-cylindrical frame member 15, only in the front-rear direction. The changing of the position of the second part-cylindrical frame member 17 may be carried out either before or after the cap holder 70 is attached to the cap-holder supporting apparatus 1.

Subsequently, the cap holder 70 is attached to the cap-holder supporting apparatus 1. First, the cap holder 70 is positioned above the disc-like wall member 41 of the rotatable structure 40, and then is moved downward, so that the two engageable holes provided in an upper portion of the cap holder 70 are engaged with the two upward projections 42 of the rotatable structure 40, respectively. The positioning of the cap holder 70 relative to the rotatable structure 40 is easily achieved by engaging the two holes of the holder 70 with the two projections 42 of the structure 40. In this state, the cap holder 70 is slightly inclined.

Next, the rear end of the cylindrical main frame member 71 of the cap holder 70 is pressed against the respective front ends of the roller supporting portions 44 of the rotatable structure 40. In this step, the rear end of the cylindrical main frame member 71 is guided by the two guide portions 47 of the rotatable structure 40, and the two roller members 46 are engaged, under the elastic forces of the sheet-like springs 45, with the remaining, two holes of the cap holder 70, respectively. Thus, the cap holder 70 is securely attached to the cap-holder supporting apparatus 1, with the upper two holes of the former 70 being engaged with the two upward projections 42 of the latter 1 and with the lower two holes of the former 70 being engaged with the two roller members 46 and guide portions 47 of the latter 1. Since the upper portion of the cap holder 70 is engaged with the upper projections 42, the cap holder 70 is easily engaged with the roller members 46, with a small pressing force, by utilizing the principle of the lever, i.e., by rotating the cap holder 70 about the projections 42.

Next, there will be described the manner in which a cap is set on the cap holder 70 supported by the cap-holder supporting apparatus 1. First, after the pressing frame member 80 is taken off the cylindrical main frame member 71, the cap is put on the main frame member 71, by being moved in the rearward direction. Next, the pressing frame member 80 externally fits on the cap, so that the cap is pinched between the pressing frame member 80 and the main frame member 71. Subsequently, in order to move one of the two temporal portions of the cap to an appropriate position easily visible or accessible by the operator, the cap holder 70 is rotated with the rotatable structure 40, relative to the fixed frame member 5, owing to the connecting device 50. Thereafter, the cap holder 70 is stopped at the appropriate angular position, by inhibiting the free rotation of the rotatable structure 40 with the help of the fastening device 60. In this state, the operator can minutely adjust or correct the position and shape of the cap being held on the cap holder 70, and connects the metal members 81 of the pressing frame member 80 to the hook members 72 of the main frame member 71. Thus, the setting of the cap on the cap holder 70 is completed.

The two lower holes of the cap holder 70 can easily be released from the two roller members 46 and guide portions 47 of the rotatable structure 40, respectively, by drawing lower portions of the cap holder 70 in the frontward direction. Subsequently, the two upper holes of the cap holder 70 can be disengaged from the upward projections 42, while the cap holder 70 as a whole is moved in the upward direction. Thus, the cap holder 70 is detached from the cap-holder supporting apparatus 1.

Subsequently, the cap holder 70 on which the cap is held is attached to an embroidery sewing machine (not shown), so that an embroidery is formed, by the sewing machine, in an embroidery area or areas of the cap.

When the cap holder 70 is detached from the cap-holder supporting apparatus 1 and subsequently is attached to the embroidery sewing machine, the shape of the embroidery area or portion of the cap being held by the cap holder 70 may be deformed or deteriorated to some degree. However, since the cap has been set on the cap holder 70 with the embroidery area portion thereof being stretched with advantages, the cap can easily be restored to an appropriate shape even after the cap holder 70 is attached to the sewing machine. There is known an embroidery sewing machine having an exclusive device for stretching an embroidery area or portion of a cap being held on a cap holder.

As is apparent from the foregoing description, in the present cap-holder supporting apparatus 1, the rotatable structure 40 is rotatably connected, by the connecting device 50, to the two connecting members 13 fixed to the fixed frame member 5. Therefore, the cap holder 70 being attached to the rotatable structure 40 can be rotated around the first part-cylindrical frame member 15. Thus, the operator can easily move, to the top position easily visible from the operator, an embroidery area in a temporal portion of the cap which portion is not easily visible from the operator. Thus, the operator can easily adjust or correct the position and shape of the cap being held on the cap holder 70. Accordingly, the amount of working of the operator is reduced and the working efficiency is improved.

In addition, the connecting device 50 enjoys a simple construction which is provided by the arcuate slit 51 formed in the rotatable structure 40, and the two pin members 52 which are associated with the two connecting members 13, respectively, and which extend through the arcuate slit 51. This leads to reducing the production cost of the present cap-holder supporting apparatus 1.

Since the present cap-holder supporting apparatus 1 is provided with the fastening device 60 for fastening the rotatable structure 40 to the fixed frame member 5 such that the structure 40 can be unfastened from the member 5, the cap holder 70 being attached to the rotatable structure 40 can be stopped at an appropriate angular position where the operator can easily adjust the position and shape of the cap being held on the cap holder 70. Thus, the cap can easily be set on the cap holder 70 such that the cap has an appropriate position and shape.

The fastening device 60 enjoys a simple construction which is provided by the two pin members 52, and the threaded portions 63 and knob 64 associated with each pin member 52. This leads to reducing the production cost of the present cap-holder supporting apparatus 1. In addition, since the fastening device 60 shares the pin members 52 with the connecting device 50, the present apparatus 1 enjoys a simple construction.

The second part-cylindrical frame member 17 is provided in front of the first part-cylindrical frame member 15 such that the position of the second frame member 17 is changeable relative to the first frame member 15 in the front-rear direction. Therefore, the present cap-holder supporting apparatus 1 can be applied to caps in various sizes (in particular, in various depths), by changing the position of the second part-cylindrical frame member 17 relative to the first part-cylindrical frame member 15. Thus, each cap can be set on the cap holder 70 such that an embroidery area or portion of the cap is stretched in an appropriate fashion.

The guiding device 20 guides the movement of second part-cylindrical frame member 17 such that the second frame member 17 is movable relative to the first part-cylindrical frame member 15 in the front-rear direction only. Thus, the second frame member 17 can easily and reliably be moved relative to the first frame member 15. The guiding device 20 enjoys a simple construction which is provided by the engagement recess 21 of the first part-cylindrical frame member 15, the engagement projection 22 of the second part-cylindrical frame member 17, and the part-cylindrical guide plates 23 which are fixed to the lower surface of the first frame member 15 and which project to support the lower surface of the second frame member 17.

Since the present cap-holder supporting apparatus 1 is provided with the position changing device 30 for changing the position of the second part-cylindrical frame member 17 in the front-rear direction, the operator can easily change the position of the second part-cylindrical frame member 17 relative to the first part-cylindrical frame member 15.

In addition, the position changing device 30 enjoys a simple construction which is provided by the first projection 31 projecting from the lower surface of the first part-cylindrical frame member 15, the second projection 33 projecting from the lower surface of the second part-cylindrical frame member 17, and the screw member 37 which is rotatably connected to the first projection 31 and is threadedly engaged with the threaded hole 34 of the second projection 33. Since the screw member 37 has the manually operable knob 36, the operator can easily operate the position changing device 30 by manually rotating the knob 36 of the screw member 36.

Figure 7:
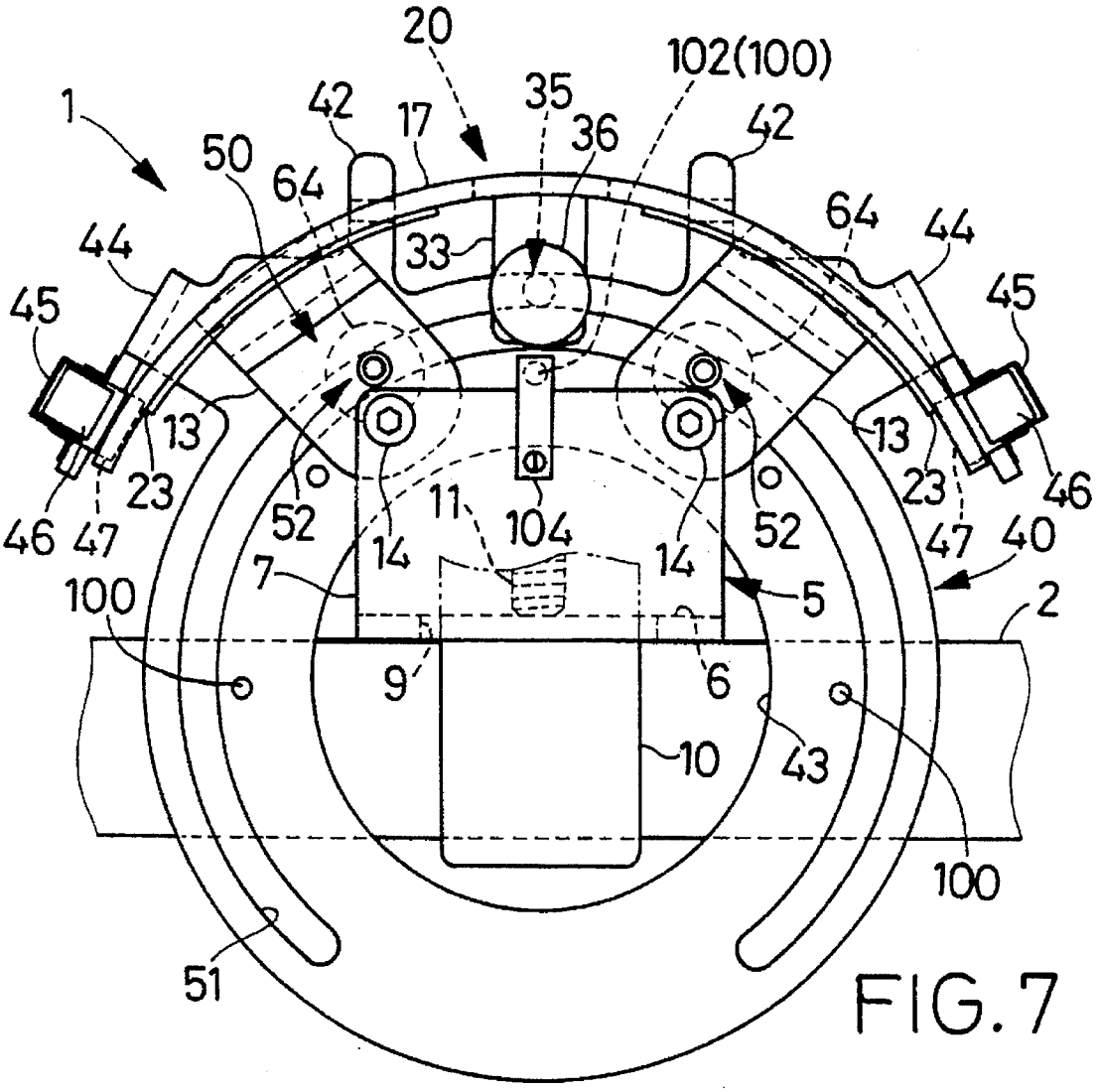
FIG. 7 is a front elevation view corresponding to FIG. 4, showing another cap-holder supporting apparatus as a second embodiment of the present invention.

Referring next to FIG. 7, there is shown another cap-holder supporting apparatus as a second embodiment of the present invention. The second embodiment has a construction similar to that of the first embodiment shown in FIGS. 1–6, and is different from the first embodiment in that in the second embodiment a rotatable structure 40 has a plurality of engageable holes 100 which are equiangularly spaced from one another about a rotation axis line of the structure 40 and that a sheet-like spring 104 having an engageable projection 102 is secured to a fixed frame member 5. Owing to an elastic deformation of the spring 104, the projection 102 is engageable with each of the holes 100 when the rotatable structure 40 is rotated about the rotation axis line. Since the projection 102 is supported by the sheet-like spring 104, the projection 102 engages, by snap action, each hole 100, thereby inhibiting the rotatable structure 40 from being freely rotated relative to the fixed frame member 5. Thus, the holes 100, projection 102, and spring 104 cooperate with one another to provide a snap-action device serving as a free-rotation inhibiting device. Owing to the free-rotation inhibiting device, the rotatable structure 40 is easily rotated and stopped at a desired angular position. In the second embodiment, the free-rotation inhibiting device may be employed in addition to, or in place of, the fastening device 60 of the first embodiment shown in FIG. 6.

Figure 8:
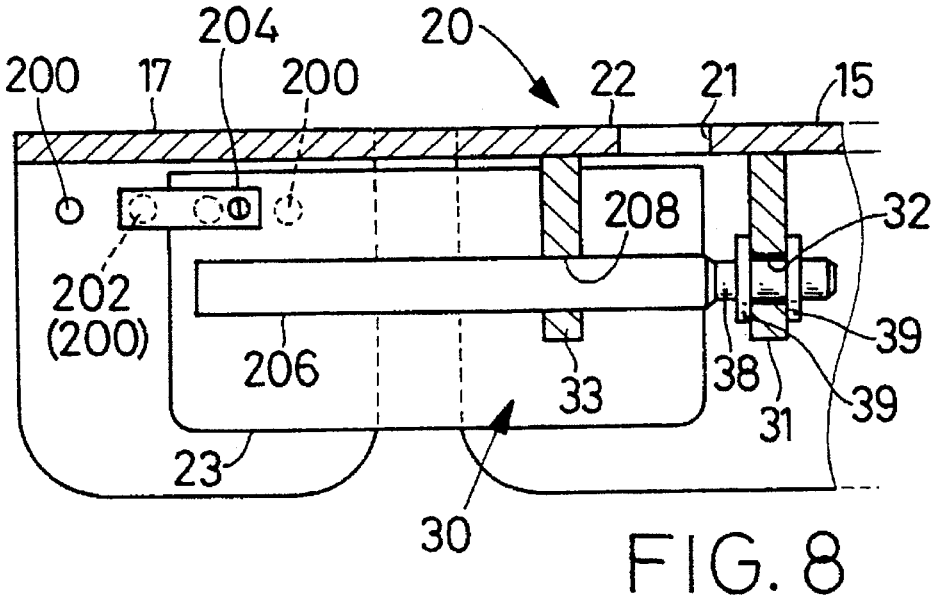
FIG. 8 is a cross-section view corresponding to FIG. 5, showing another cap-holder supporting apparatus as a third embodiment of the present invention.

Referring next to FIG. 8, there is shown another cap-holder supporting apparatus as a third embodiment of the present invention. The third embodiment has a construction similar to that of the first embodiment shown in FIGS. 1–6, and is different from the first embodiment in that in the third embodiment a second part-cylindrical frame member 17 has a plurality of engageable holes 200 which are equidistant from one another in a front-rear direction of the cap-holder supporting apparatus and that a sheet-like spring 204 having an engageable projection 202 is secured to one of two part-cylindrical guide plates 23 secured to a first part-cylindrical frame member 15. Owing to an elastic deformation of the spring 204, the projection 202 is engageable with each of the holes 200 when the position of the second part-cylindrical frame member 17 is changed relative to the first part-cylindrical frame member 15 in the front-rear direction. Since the projection 202 is supported by the sheet-like spring 204, the projection 202 engages, by snap action, each hole 200, thereby inhibiting the second frame member 17 from being freely moved relative to the first frame member 15. A guide bar 206 is connected to a first projection 31 such that the guide bar 206 is not movable in an axial direction thereof, i.e., the front-rear direction. The guide bar 206 extends through a guide hole 208 formed through a second projection 33. When the second frame member 17 is moved relative to the first frame member 15, the guide bar 206 guides the movement of the second frame member 17 in the front-rear direction only. Thus, the holes 200, projection 202, and spring 204 cooperate with one another to provide a snap-action device serving as a position changing device 30 for changing the position of the second frame member 17 relative to the first frame member 15 in the front-rear direction. Owing to the position changing device, the second frame member 17 is easily moved and stopped at a desired position in the front-rear direction. In the third embodiment, an engagement recess 21, an engagement projection 22, part-cylindrical guide plates 23, first and second projections 31, 33, and guide bar 206 cooperate with one another to provide a guiding device 20 for guiding the movement of the second frame member 17 relative to the first frame member 15 in the front-rear direction.

Figure 9:
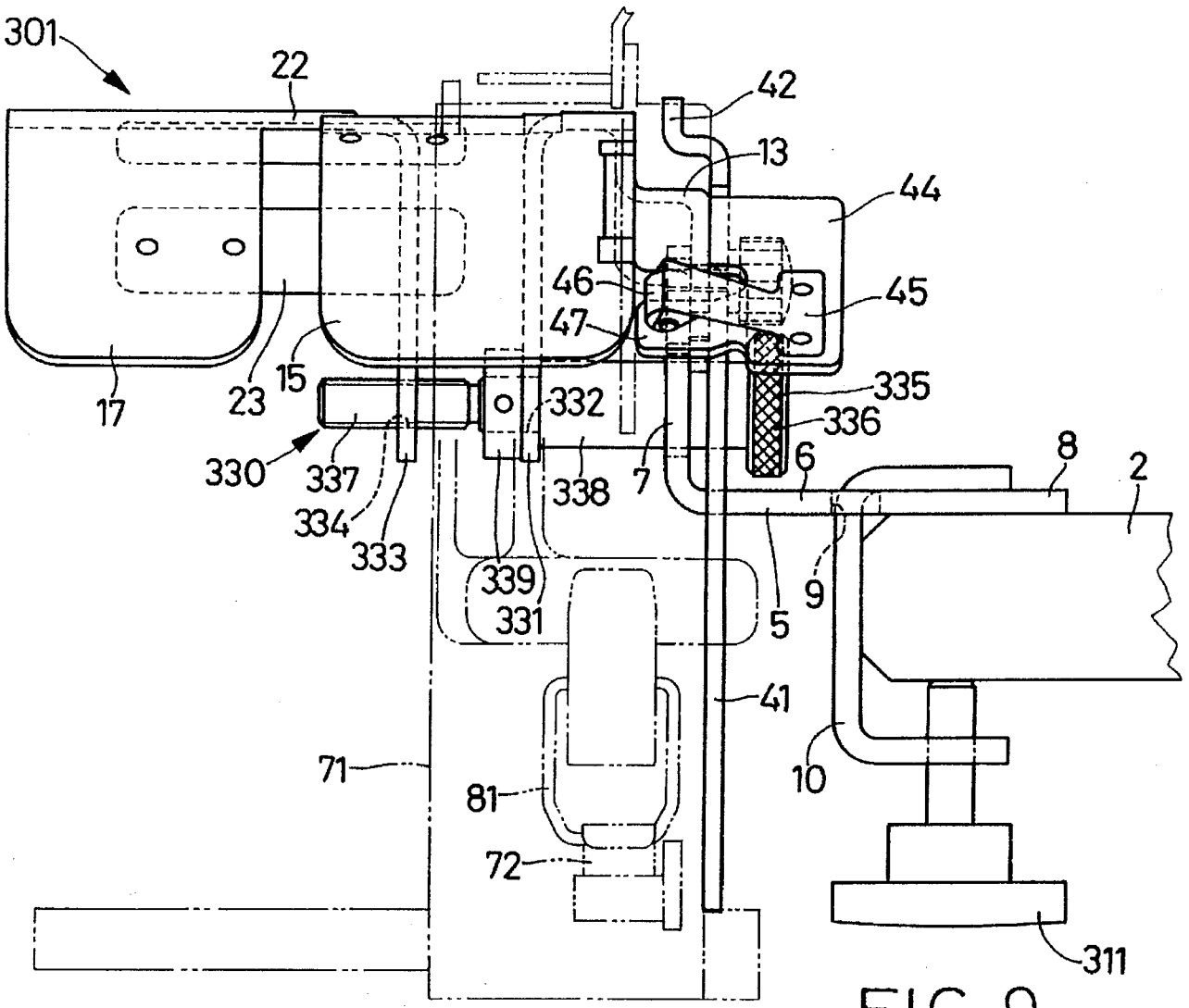
FIG. 9 is a lateral elevation view corresponding to FIG. 2, showing another cap-holder supporting apparatus as a fourth embodiment of the present invention.

Referring next to FIG. 9, there is shown another cap-holder supporting apparatus 301 as a fourth embodiment of the present invention. The fourth embodiment has a construction similar to that of the first embodiment shown in FIGS. 1–6, and is different from the first embodiment in that the fourth embodiment has a fastening bolt 311 which is threadedly engaged with a lower portion of a metal member 10 and which is rotatable to fasten or unfasten the metal member 10 to or from a table 2 and thereby fix and release the cap-holder supporting apparatus 301 to and from the table 2. In addition, the fourth embodiment has a position changing device 330 different from the position changing device 30 of the first embodiment.

As shown in FIG. 9, the position changing device 330 includes a first and a second projection 331, 333, and a screw member 335 with a manually operable knob 336. The first projection 331 projects from a lower surface of a first part-cylindrical frame member 15, and the second projection 333 projects downward from a rear end of an engagement projection 22 of a second part-cylindrical frame member 17. The screw member 335 includes an externally threaded axis portion 337, and a large-diameter axis portion 338 whose diameter is larger than that of the threaded portion 337. The large-diameter axis portion 338 includes a stepped portion which is inserted through a support hole 332 formed through the thickness of the first projection 331. The small-diameter axis portion 338 is connected, with one ring member 339, such as an E-shaped ring, provided on one side of the first projection 331, to the first projection 331 such that the screw member 335 is rotatable about an axis line thereof and is not movable relative to the first projection 331 in the axial direction thereof, i.e., in the front-rear direction. The ring member 339 may be replaced by a spring pin which is inserted in a hole formed through the stepped portion of the axis portion 338. The externally threaded axis portion 337 is inserted through, and engaged with, an internally threaded hole 334 formed through the thickness of the second projection 333. The large-diameter axis portion 338 extends rearward through an insertion hole of a vertical portion 7 of a fixed frame member 5 and an insertion hole 43 of a disc-like wall member 41. The knob 336 is secured to a rear end of the large-diameter axis portion 338, and is positioned rearward of the disc-like wall member 41 of a cap-holder supporting rotatable structure 40. When the knob 336 is manually rotated by an operator or worker, the screw member 335 is rotated about the axis line thereof, so that the second part-cylindrical frame member 17 is moved via the second projection 333 relative to the first part-cylindrical frame member 15 in the front-rear direction, while being guided by a guiding device 20. Thus, the position of the second part-cylindrical frame member 17 is changed relative to the first part-cylindrical frame member 15 in the front-rear direction.

In the fourth embodiment, since the knob 336 is provided between the cap-holder supporting rotatable structure 40 and the table 2, the position of the second part-cylindrical frame member 17 can easily be changed by rotating the knob 336, even with a cap holder 70 and a cap being attached to the rotatable structure 40.

While the present invention has been described in its preferred embodiments, the present invention can otherwise be embodied with various changes.

For example, in the first embodiment shown in FIGS. 1 to 6, the connecting device 50 includes the two pin members 52 each of which is supported by a corresponding one of the two connecting members 13 and each extends through the arcuate slit 51 of the rotatable structure 40. However, it is possible that two or more pin members 52 be supported by each connecting member 13 so as to extend through the arcuate slit 51.

Although the arcuate slit 51 of the wall member 41 of the rotatable structure 40 has the central angle of 290 degrees, it is possible that the arcuate slit 51 be formed to have a central angle other than 290 degrees for the purpose of improving the work efficiency.

While in the first embodiment the fastening device 60 is provided by the two pin members 52 and the threaded portions 63 (61, 62) and knob 64 associated with each pin member 52, it is possible that the fastening device 60 be provided by either one of the two pin members 52 and the threaded portions 63 and knob 64 associated with the single pin member 52. Also in the above-indicated modified case where two or more pin members 52 are supported by each connecting member 13 and extend through the arcuate slit 51, it is possible that the fastening device 60 be provided by at least one of the two or more pin members 52 and the threaded portions 63 and knob 64 associated with the one pin member 52.

Although in the first embodiment the guiding device 20 includes the engagement recess 21 of the first part-cylindrical frame member 15 and the engagement projection 22 of the second part-cylindrical frame member 17, it is possible that the guiding device 20 include an engagement recess formed in the second frame member 17 and an engagement projection extending from the first frame member 15.

In the first embodiment, the position changing device 30 includes the screw member 35 which is rotatably connected to the first projection 31 and is threadedly engaged with the second projection 33. However, it is possible that the first projection 31 have an internally threaded hole and the second projection 33 has a support hole and that a screw member include an externally threaded, end portion which is threadedly engaged with the internally threaded hole of the first projection 31, and also include an intermediate axis portion which is rotatably connected to the second projection 33 such that the screw member is not movable relative to the second projection 33 because of the provision of ring members like the members 39. In the latter case, too, the screw member may have a manually operable knob at the same position as the position where the screw member 35 has the knob 36 as shown in FIG. 5.

The present cap-holder supporting apparatus 1 may be used to support various sorts of cap holders each of which can be attached to the rotatable structure 40.

It is to be understood that the present invention may be embodied with other changes, improvements, and modifications that may occur to those skilled in the art without departing from the scope and spirit of the invention defined in the appended claims.

What is claimed is:

1. A headgear-holder supporting apparatus for supporting a headgear holder which holds a headgear, the headgear holder being detachably attached to the headgear-holder supporting apparatus, the headgear being held by the headgear holder attached to the headgear-holder supporting apparatus before the headgear holder and the headgear held thereby are attached to a sewing machine independent of the headgear-holder supporting apparatus, the headgear-holder supporting apparatus comprising:

a main structure comprising a main frame member which is adapted to be fixed to a base member such that said main frame member extends in a predetermined direction and is not movable relative to the base member in said predetermined direction, said main structure comprising a curved portion;

a rotatable structure which supports the headgear holder attached thereto; and a connecting device which connects said rotatable structure supporting the headgear holder, to said main structure, such that the rotatable structure is rotatable about an axis line thereof parallel to said predetermined direction and such that said main frame member extends, in the predetermined direction, in an inside space of the headgear holder attached to the rotatable structure, so that the headgear holder is rotatable around the main frame member of said main structure, said curved portion of said main structure extending, in said predetermined direction, into an internal space of the headgear held by the headgear holder attached to the rotatable structure, the curved portion being upward curved so as to provide an upper surface thereof extending along an inner surface of the headgear.

2. An apparatus according to claim 1, wherein said main structure comprises a fixed member which is adapted to be fixed to the base member, and said main frame member which is secured to said fixed member and which extends into said inside space of the headgear holder attached to said rotatable structure.

3. An apparatus according to claim 2, wherein said main frame member comprises a curved portion.

4. An apparatus according to claim 1, wherein said connecting device comprises an arcuate guide provided on one of said main structure and said rotatable structure, and at least one guided member which is provided on the other of the main structure and the rotatable structure and which is guided by said arcuate guide.

5. An apparatus according to claim 4, wherein said arcuate guide comprises an arcuate groove formed in said one of said main structure and said rotatable structure, and said at least one guided member comprise a plurality of projecting members which project from said other of the main structure and the rotatable structure and which fit in said arcuate groove.

6. An apparatus according to claim 1, wherein said connecting device comprises an arcuate slit formed through a thickness of said rotatable structure, and a plurality of pin members which are secured to said main structure and which extend through said arcuate slit.

7. An apparatus according to claim 1, further comprising a free-rotation inhibiting device which inhibits said rotatable structure from being freely rotated relative to said main structure, such that the rotatable structure is forcedly rotatable relative to the main structure.

8. An apparatus according to claim 7, wherein said free-rotation inhibiting device comprises a fastening device which fastens said rotatable structure to said main structure such that the rotatable structure being fastened is unfastenable from the main structure.

9. An apparatus according to claim 8, wherein said connecting device comprises an arcuate slit formed through a thickness of said rotatable structure, and a plurality of pin members which are secured to said main structure and which extend through said arcuate slit, and wherein said fastening device comprises at least one threaded hole formed in said main structure, and at least one of said pin members which includes a threaded portion engageable with said threaded hole and additionally includes a manually operable knob having a dimension greater than a width of said arcuate slit, said rotatable structure being fastened to said main structure by rotating said knob of said one pin member until the rotatable structure is sandwiched and fixed between the main structure and the knob of said one pin member.

10. An apparatus according to claim 7, wherein said free-rotation inhibiting device comprises a snap-action device which inhibits, by snap action, the rotation of said rotatable structure relative to said main structure.

11. An apparatus according to claim 1, wherein said rotatable structure comprises a holding device which holds the headgear holder attached thereto.

12. An apparatus according to claim 11, wherein said holding device comprises one of (a) at least one projection which is engageable with at least one hole formed in the headgear holder and (b) at least one hole which is engageable with at least one projection projecting from the headgear holder.

13. An apparatus according to claim 11, wherein said holding device comprises one of (a) a combination of (a1) at least one roller which is engageable with at least one hole formed in the headgear holder and (a2) at least one guide plate which cooperates with said at least one roller to hold the headgear holder, and (b) at least one hole which is engageable with at least one roller and at least one guide plate provided on the headgear holder.

14. An apparatus according to claim 11, wherein said holding device comprises at least one projection which projects from said rotatable structure and which is engageable with at least one first hole formed in the headgear holder, and comprises a plurality of rollers which are engageable with a plurality of second holes formed in the headgear holder, and a plurality of guide plates which cooperate with the corresponding ones of said rollers to hold the headgear holder, said plurality of rollers comprising two rollers which are provided on said rotatable structure, on both sides of said projection, said plurality of guide plates comprising two guide plates corresponding to said two rollers, the headgear holder being attached to said rotatable structure by first engaging said projection with said first hole formed in the headgear holder and subsequently rotating, like a lever, the headgear holder about the projection and hole being engaged, so that said two rollers and said two guide plates are engaged with corresponding two second holes of said plurality of second holes of the headgear holder.

15. A headgear-holder supporting apparatus for supporting a headgear holder which holds a headgear, the headgear holder being detachably attached to the headgear-holder supporting apparatus, the headgear being held by the headgear holder attached to the headgear-holder supporting apparatus before the headgear holder and the headgear held thereby are attached to a sewing machine independent of the headgear-holder supporting apparatus, the headgear-holder supporting apparatus comprising:

a main structure comprising a main frame member which is adapted to be fixed to a base member such that said main frame member is not movable relative to the base member, said main structure comprising a curved frame member;

a supporting structure which supports the headgear holder attached thereto and which is connected to said main structure, said curved frame member of said main structure extending, in a predetermined direction, into an internal space of the headgear held by the headgear holder supported by said supporting structure, the curved frame member being upward curved so as to provide an upper surface thereof extending along an inner surface of the headgear; and a position changing device which changes a position of said curved frame member relative to said main frame member in said predetermined direction.

16. An apparatus according to claim 15, wherein said main structure comprises a fixed member which is adapted to be fixed to the base member, said main frame member being secured to said fixed member and extending in an inside space of the headgear holder attached to said supporting structure.

17. An apparatus according to claim 15, wherein said main frame member comprises a curved portion, said curved frame member having the same curved shape as the curved shape of said curved portion.

18. An apparatus according to claim 17, wherein said main frame member comprises a part-cylindrical portion as said curved portion, said predetermined direction being substantially parallel to a center axis line of said part-cylindrical portion.

19. An apparatus according to claim 15, further comprising a guiding device which guides a movement of said curved frame member relative to said main frame member in said predetermined direction.

20. An apparatus according to claim 19, wherein said guiding device comprises an engagement recess formed in one of said main and curved frame members, an engagement projection projecting from the other of said main and curved frame members and held in engagement with said engagement recess, and at least one curved guide plate which is fixed to said main frame member and guides said movement of said curved frame member.

21. An apparatus according to claim 19, wherein said position changing device comprises a snap-action device which inhibits, by snap action, said movement of said curved frame member relative to said main frame member.

22. An apparatus according to claim 15, wherein said position changing device comprises a continuously moving device which changes said position of said curved frame member relative to said main frame member in said predetermined direction, by continuously moving and positioning the curved frame member relative to the main frame member.

23. An apparatus according to claim 22, wherein said continuously moving device comprises a connecting member which includes a first portion thereof connected to one of said main and curved frame members such that said connecting member is rotatable about an axis line thereof, and not immovable in an axial direction thereof, relative to said one of said main and curved frame members and which includes an externally threaded second portion threadedly engaged with, and extending through, an internally threaded hole formed in the other of said main and curved frame members.

24. An apparatus according to claim 23, wherein said continuously moving device further comprises a first projection projecting from said main frame member, and a second projection projecting from said curved frame member, said first portion of said connecting member being connected to one of said first and second projections such that said connecting member is rotatable about said axis line thereof, and not immovable in said axial direction thereof, relative to said one projection and said externally threaded second portion thereof is threadedly engaged with, and extends through, said internally threaded hole formed in the other projection.

25. An apparatus according to claim 23, wherein said connecting member comprises a manually operable knob provided at one of opposite ends thereof, said one end being nearer to said first portion of the connecting member than to said externally threaded second portion of the connecting member, said curved frame member being continuously moved relative to said main frame member in said predetermined direction by rotating said knob of the connecting member.

26. An apparatus according to claim 25, wherein said first portion of said connecting member is connected to said main frame member and said externally threaded second portion of the connecting member is threadedly engaged with said curved frame member.

27. An apparatus according to claim 23, wherein said connecting member comprises a manually operable knob provided at one of opposite ends thereof, said one end being more remote from said first portion of the connecting member than from said externally threaded second portion of the connecting member, said curved frame member being continuously moved relative to said main frame member in said predetermined direction by rotating said knob of the connecting member.

28. An apparatus according to claim 27, wherein said first portion of said connecting member is connected to said main frame member and said externally threaded second portion of the connecting member is threadedly engaged with said curved frame member.

29. An apparatus according to claim 1, wherein said main structure comprises a curved frame member comprising said curved portion.

30. An apparatus according to claim 29, further comprises a position changing device which changes a position of said curved frame member relative to said main frame member in said predetermined direction.

31. An apparatus for supporting a headgear holder which holds a headgear, the headgear holder being detachably attached to the apparatus, the apparatus comprising:

a main structure which is adapted to be fixed to a base member;

a rotatable structure which supports the headgear holder attached thereto;

a connecting device which connects said rotatable structure supporting the headgear holder, to said main structure, such that the rotatable structure is rotatable about an axis line thereof, so that the headgear holder is rotatable around said main structure; and a free-rotation inhibiting device which inhibits said rotatable structure from being freely rotated relative to said main structure, said free-rotation inhibiting device comprising a fastening device which fastens said rotatable structure to said main structure such that the rotatable structure being fastened is unfastenable from the main structure.

32. An apparatus for supporting a headgear holder which holds a headgear, the headgear holder being detachably attached to the apparatus, the apparatus comprising:

a main structure which is adapted to be fixed to a base member;

a rotatable structure which supports the headgear holder attached thereto;

a connecting device which connects said rotatable structure supporting the headgear holder, to said main structure, such that the rotatable structure is rotatable about an axis line thereof, so that the headgear holder is rotatable around said main structure; and a free-rotation inhibiting device which inhibits said rotatable structure from being freely rotated relative to said main structure, said free-rotation inhibiting device comprising a snap-action device which inhibits, by snap action, the rotation of said rotatable structure relative to said main structure, such that the rotatable structure is forcedly rotatable relative to the main structure.

* * * * *